United States Patent [19]

Carr

[11] 4,111,114

[45] Sep. 5, 1978

[54] MACHINE FOR APPLYING NAIL PLATES FOR TRUSS ASSEMBLY

[75] Inventor: Ronald R. Carr, Detroit, Mich.

[73] Assignee: The Panel Clip Co., Farmington, Mich.

[21] Appl. No.: 782,070

[22] Filed: Mar. 28, 1977

[51] Int. Cl.[2] ..... B30B 7/00

[52] U.S. Cl. ..... 100/100; 100/DIG. 13; 100/231; 100/264; 227/152; 269/321 F

[58] Field of Search ..... 100/231, 264, 100, DIG. 13; 227/152; 269/321 F; 144/288 C

[56] References Cited

U.S. PATENT DOCUMENTS

| | | | |
|---|---|---|---|
| 3,207,406 | 9/1965 | Bowman | 100/264 |
| 3,388,657 | 6/1968 | Jureit | 100/DIG. 13 |
| 3,487,430 | 12/1969 | Schmitt | 100/DIG. 13 |
| 3,530,790 | 9/1970 | Post | 100/DIG. 13 |
| 3,742,569 | 7/1973 | Moehlenpah | 100/DIG. 13 |
| 3,866,530 | 2/1975 | Moehlenpah | 269/321 F |
| 3,896,717 | 7/1975 | Schmitt | 100/DIG. 13 |
| 3,978,783 | 9/1976 | Moehlenpah | 100/DIG. 13 |
| 4,002,116 | 1/1977 | Knowles | 100/DIG. 13 |

*Primary Examiner*—Billy J. Wilhite

*Attorney, Agent, or Firm*—Harness, Dickey & Pierce

[57] ABSTRACT

A machine is provided for assemblying the elements of a truss and fastening them together in a positive manner. A supporting table is made up of channel elements which have platforms thereon which are movable upwardly and are adjustable in a horizontal plane toward and away from the center of the table. A carriage runs upon spaced tracks to locate pressure plates which are mounted on a pair of like C-frames which are adjustable toward and away from each other so as to be effective for trusses of different heights. The pressure plates are moved toward each other and apply a substantial pressure for inserting a multiplicity of nails of a nail plate into the areas in which the members of the truss are to be secured together. This provides a truss of exact shape and dimension which is positively secured together and, where necessary, is provided with a rectangular opening in which a heating and/or cooling duct is supported.

15 Claims, 11 Drawing Figures

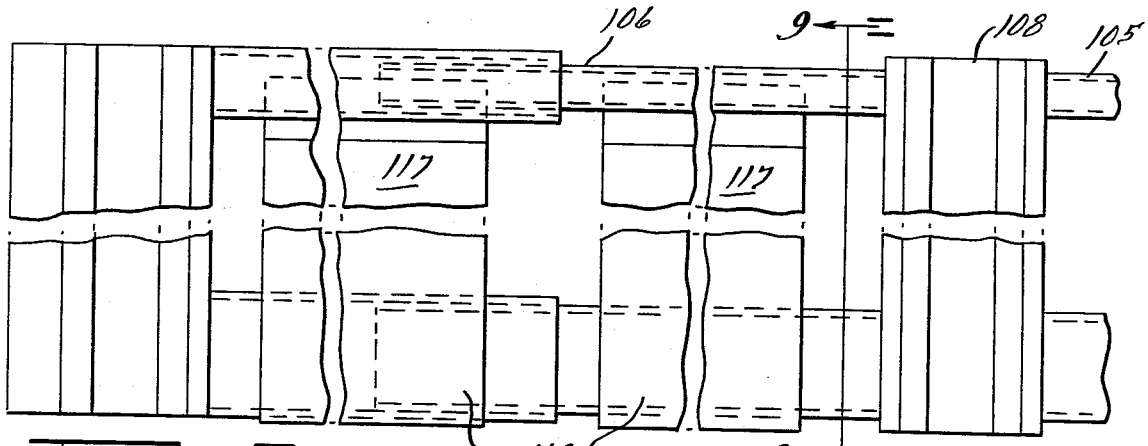
FIG. 8.
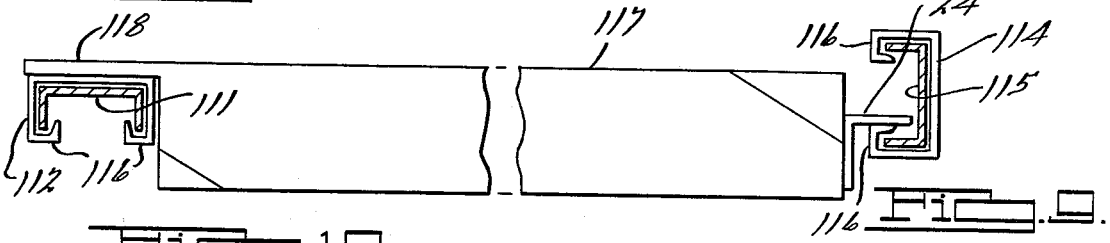
FIG. 9.
FIG. 10.
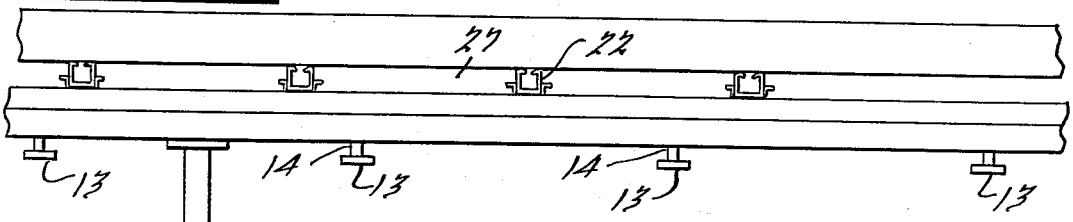
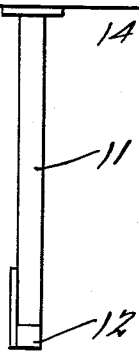
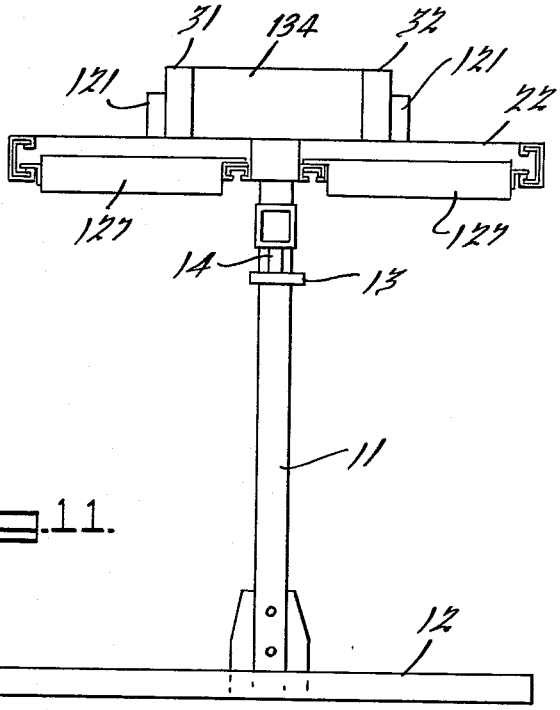
FIG. 11.

MACHINE FOR APPLYING NAIL PLATES FOR TRUSS ASSEMBLY

BACKGROUND OF THE INVENTION

While various means have been provided for securing nail plates at the junction of the wood members of the truss, it is believed that the use of the heavy C-frames mounted within a carriage which advances the C-frames from one position to another, and to be operated alone or simultaneously, is new with applicant. It was found that applying pressure to the entire nail plate at the bottom and the top of the truss sets the nails a maximum amount within the wood members providing assurance that the joints will be firmly maintained.

SUMMARY OF THE INVENTION

A pair of large facing C-frames are supported on an I-beam at the top of a carriage for adjustment toward and away from each other so as to be available for securing the members of a truss together which may vary from 12 to 24 inches in height. The C-frames are supported on a heavy coiled spring for vertical movement and a ram is supported between each pair of C-shaped members at the bottom for supporting a ram beneath a pressure plate which is operated by the ram piston rod to move the pressure plate upwardly. The plate carries a bracket to which a vertical movable rod is pivoted which operates a lever which applies a downward pressure and movement to the C-frame to move a top pressure plate downwardly. Each pressure plate has a movement of one inch toward each other. Fluid is directed to and from the rams from a standard source by solenoid valves which permits either or both of the C-frames to operate simultaneously or separately. At the center of the C-frames, between the pressure plates, nail plates are supported on the bottom of a raisable platform and on the top of the truss assembly. The carriage for the C-frames is advanced on spaced tracks at the rate of 60 feet a minute to align one or both of the C-frames at the point or points where the nail plates are located. When the piston rod is actuated, the two pressure plates move toward each other and applies a substantial force to set the nails of the nail plates. The hydraulic system has a 16 ton capacity for setting the nails of the nail plates a maximum degree. After the carriage has been moved from one to the other end of the truss, the assemblied truss may be removed and the members of another truss may be assembled on the table to have the the abutting ends of the members to be secured together joined by the nail plates as pointed out above.

BRIEF DESCRIPTION OF THE DRAWINGS

FIG. 8 is an enlarged broken plan view of the central portion of the machine illustrated in FIGS. 1 and 2;

FIG. 9 is an enlarged broken view of a platform adjustable on telescoped members illustrated in FIG. 8;

FIG. 10 is a side view of the machine illustrated in FIGS. 1 and 2 showing the locking means for the adjustable portion thereof, and FIG. 11 is an end view of the structured illustrated in FIG. 10.

DESCRIPTION OF THE PREFERRED EMBODIMENT

Figure 1:
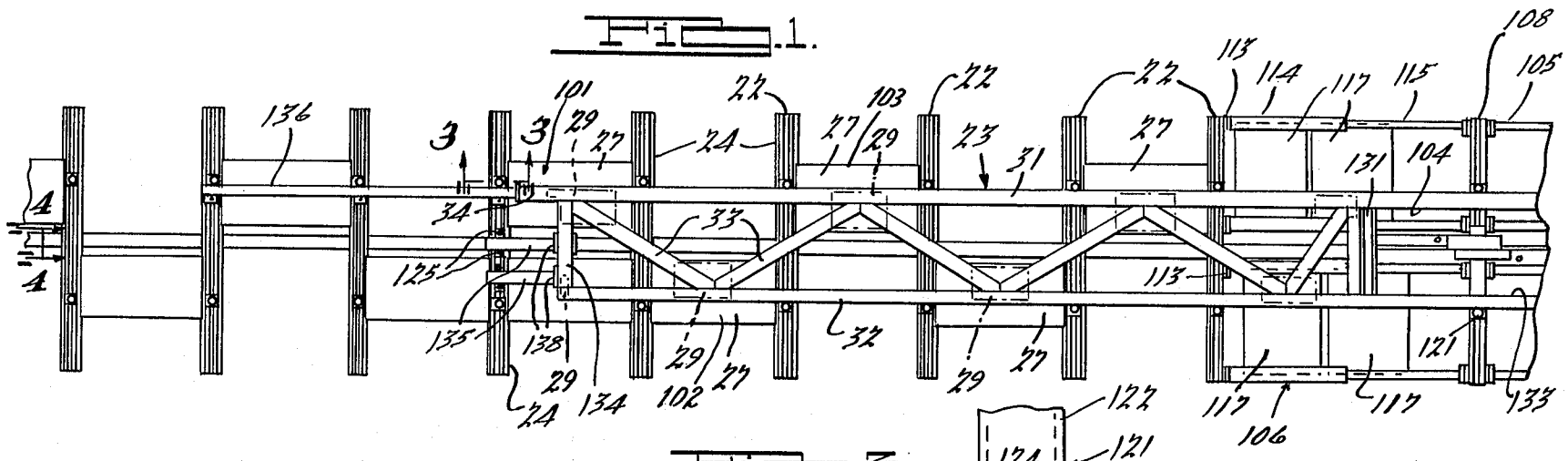
FIG. 1 is a view of one end of a machine with a truss thereon over which a carriage containing a pair of the C-frames is advanced all of which embodies features of the present invention.
Figure 2:
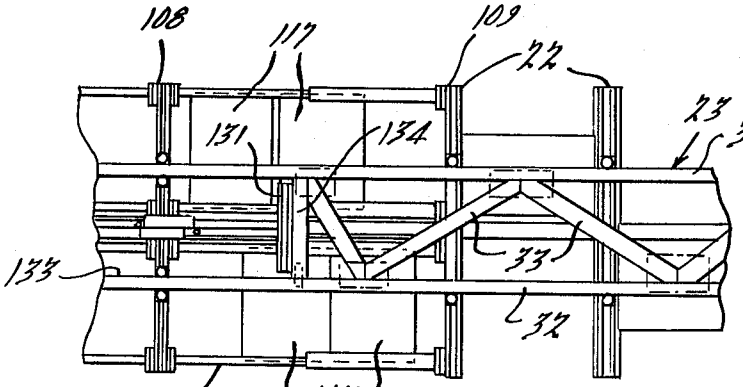
FIG. 2 is a broken view of a continuing section of the machine illustrated in FIG. 1.
Figure 4:
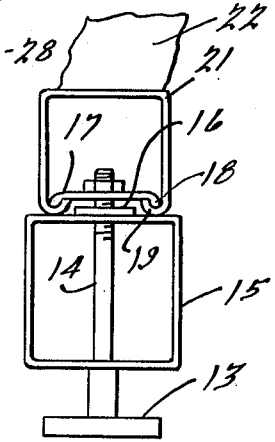
FIG. 4 is an enlarged sectional view of the structure illustrated in FIG. 1, taken on the line 4—4 thereof.
Figure 5:
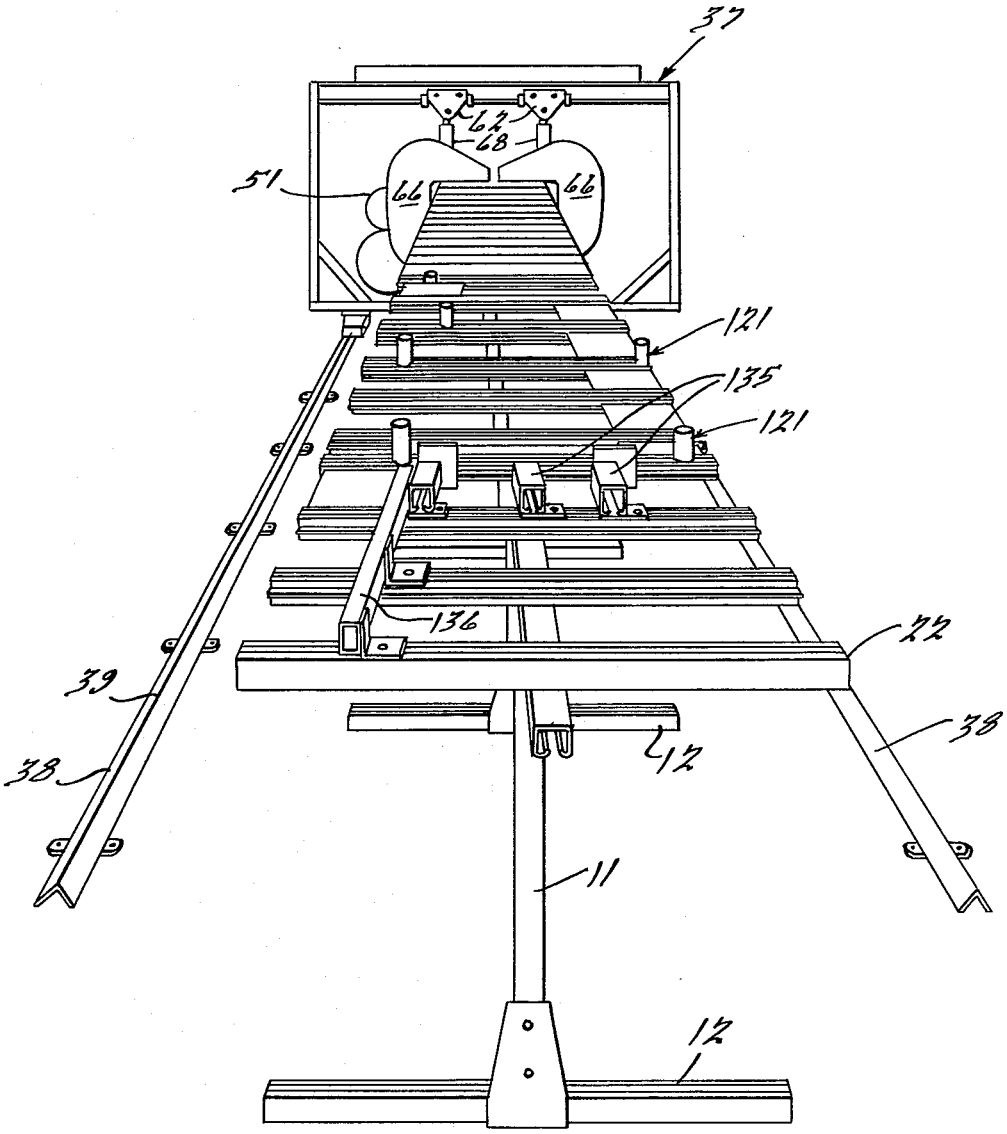
FIG. 5 is a perspective view of the structure illustrated in FIG. 1, as viewed from the lefthand end thereof.
Figure 6:
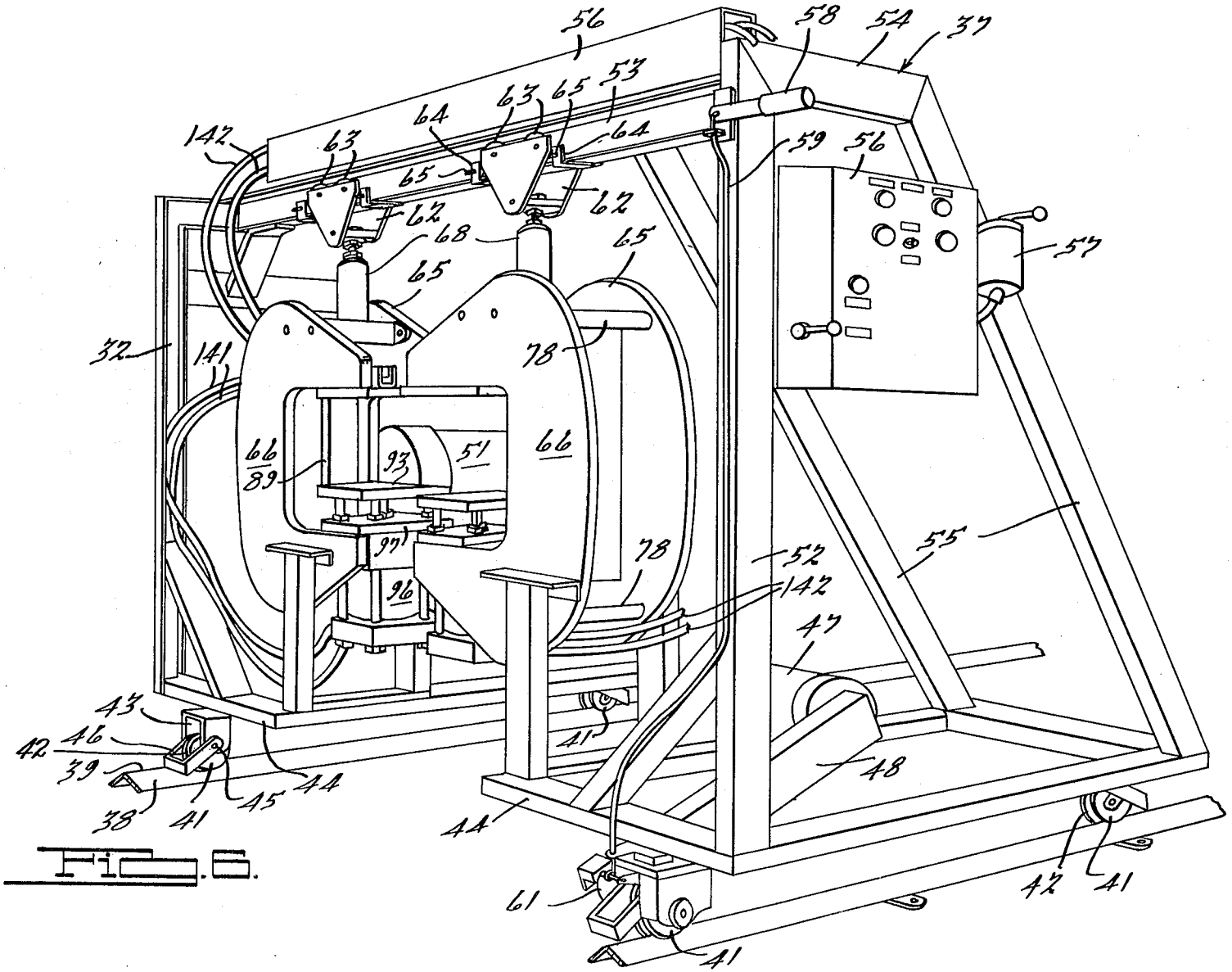
FIG. 6 is a perspective view of the carriage which is visible at the remote end of the structure illustrated in FIG. 5.
Figure 7:
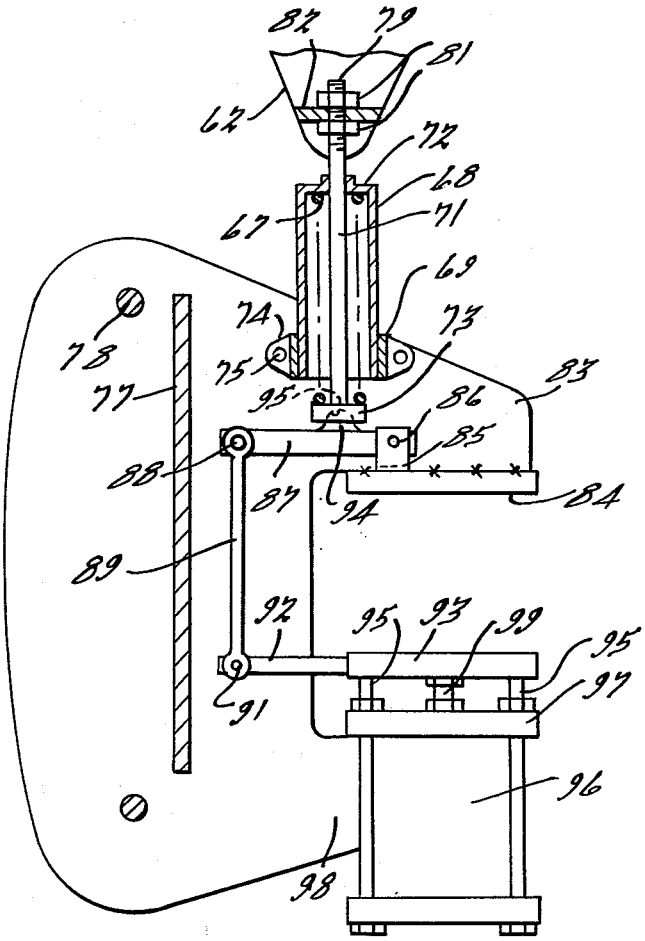
FIG. 7 is a view in elevation of a C-frame with one element of the C-frame removed.

The supporting table for the truss embodies a plurality of legs 11 which are mounted on cross members 12 which are secured to the floor. In the construction herein illustrated, there is one of the legs 11 on cross members 12 in the center of the assembly and three legs 11 spaced each side therefrom supporting the table on which the members of a truss of approximately 32 feet in length may be assembled and secured together. It is to be understood that machines of greater or shorter lengths will be employed depending upon the length of truss to be assembled. The top of each leg 11 has a plate 13 welded thereto and to a square runner 15 which is provided along the center of the machine. A narrow guide strip 16 is welded to the top of the runner 15 along the length thereof. An inverted U-shaped channel shaped member extends along the runner and is clamped in adjusted position by a plate 17 having a bolt 14 extending through apertures in the top and bottom of the runner, the guide strip 16 and a nut 20 welded to the plate 17. The plate 17 has downwardly extending edge flanges 18 which project into inwardly facing grooves 19 at the open end of an inverted channel shaped member 21. The member 21 provides a support for transverse cross members 22 which are welded or otherwise secured thereto with their open side facing upwardly. The top surfaces of the members 22 form the bed on which the truss 23, as illustrated in FIGS. 1 and 2, have their members assembled in securable relation. The legs 11, the cross members 12 and 22 are of channel shape having the metal at the top open face curved inwardly to form the groove 19 along each side. The cross members 22 with their open face extending upwardly can have various elements secured thereto by suitable clips and bolts so as to be changeable at the time of different set-ups for different size of trusses.

Figure 3:
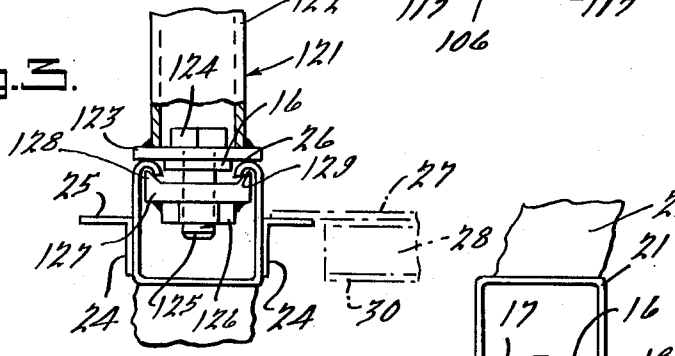
FIG. 3 is an enlarged, broken sectional view of the structure illustrated in FIG. 1, taken on the line 3—3 thereof.

As illustrated in FIG. 3, the two side elements of the channel cross members 22 have an angle member 24 welded thereto with the outwardly extending flange 25 disposed substantially three-fourths of an inch below the top 26 of the rolled edges 19. A platform 27 which is approximately 15 inches in length rests upon the top of the flanges 25 of the angle members 24, the cross members 22 being spaced apart to permit the platform to be raised and lowered from and to the flanges 25. The platforms 27 have three square tubes 28 which are 1¼ inches on each side welded thereto, the tubes having a wall thickness of approximately three-sixteenth of an inch. A plate 30 is welded to the tubes on their bottom sides to form a unit construction. As will be seen from FIGS. 1 and 2, the platforms 27 are supported between the cross members 22 on opposite sides of the centerline, in a position to have the nail plate 29 located thereon so that it can be supported thereby and still be raised to have the upwardly projecting nails thereof forced into the abutted portions of the truss members to be joined together as a like nail plate thereabove resting on the truss is forced thereinto.

The truss 23 is made from two-by-fours having a pair of outer runners 31 and 32 at the top and bottom abutting tubes 121 when spaced by angularly disposed cross members 33 which have their ends cut to mate with each other and the surface of the runners 31 and 32. Plates on locating tubes 121 are clamped on the cross members 22 and are aligned to be abutted by the outer edges of the top and bottom runners 31 and 32. Cross members 33 are forced into assembled relation with each other, the end cross member 134 and the runners which become locked in assembled position, as illustrated in FIGS. 1 and 2. The assembly is such that the point where the engagement takes place is adjacent to platforms 27 at which the securement of the abutted ends occur. It will be noted that the lefthand end 34 of the assembled truss has a pair of the nail plates 29 on each side of the centerline in aligned relation so as to have nails forced toward each other simultaneously at the top and bottom at each side of the center by the operation of the two C-frames to secure the top and bottom end elements of the truss in firm fixed relation to each other.

A carriage 37 spans the table, which is made up of the cross members 22, when mounted on a pair of rails 38 which are constructed from angle members having two sides in substantially 90° relationship to form an apex 39 which is engaged by the recess 42 in the wheels 41 of the carriage 37. The recess 42 is cut into the periphery of the wheels and has a 90° angle at the center to receive the apex 39 of each of the rails. The wheels 41 are supported in inverted U-shaped elements 43 which are attached to the bottom side frames 44 to support the wheels on an axle 45 which extends through the U-shaped elements 43. The axles 45 also support a U-shaped guard 46 adjacent to the rails which acts as safety elements to move a member from the track, and to prevent damage by the wheel 41.

The righthand bottom frame 44 supports a motor 47 having a gear reduction drive which operates a chain and sprocket drive contained within a guard 48. The chain and sprockets further reduce the speed for driving the front righthand wheel 41 for moving the carriage 37 along the spaced rails 38. The lefthand bottom frame 44 supports a fluid tank 49 having a motor 51 thereon for driving a pump for supplying fluid under pressure for operating the top and bottom pressure plates 84 and 93 which move the nail plates toward each other to secure the members of the truss together when forced thereinto.

Front uprights 52 support an I-beam 53 at the top which supports an inverted channel element 56 thereabove through which a pair of pressure hoses for the righthand ram extend when supplied from the pump on the lefthand side of the carriage. Top rearwardly extending elements 54 are joined by angularly disposed uprights 55 which are secured to the spaced bottom platform portions 44. A switch and control box 56 is supported on the righthand side of the carriage 37. A reversing switch 57 is mounted adjacent to the box 56 for advancing or reversing the motor which operates the carriage 37. A pivotal handle 58 at the top righthand side of the carriage operates a Bodin wire 59 to actuate a brake 61 for accurately stopping the machine.

The bottom flange of the I-beam 53 supports a pair of spaced hangers 62 having a pair of wheels 63 on each side for rolling along the flange. U-shaped stop members 64 are mounted on the bottom flange to be secured by bolts 65 after being moved into engagement with each side of the hanger 62. This permits the C-frames 66 supported by the hangers to be moved toward and away from each other, the position for which is determined by the width of the truss which is to have the members thereof secured together. Each hanger supports a C-frame 66 on a coiled spring 67 which is disposed within a cylinder 68 secured to a rectangular box-like element 69 through which a bolt 71 extends. An end wall 72 closes the top end of the cylinder to have the top end of the spring 67 in engagement therewith, the bottom end of the spring engaging a head 73 of the bolt. The ends of the box-like element 69 has flanges 74 on the ends which are secured by bolts 75 to the spaced C-shaped plates 76. The pair of plates are spaced apart by a steel plate 77 and by rods 78 which are welded thereto.

The threaded end 79 of the bolt 71 carries a pair of nuts 81 which clamp the bolt end to a cross plate 82 of the hanger. The top two forwardly extending arm portions 83 of the C-shaped plates have a pressure plate 84 welded or otherwise secured thereto which has a clevis 85 fixed thereto and connected by a pin 86 to a lever 87. The rear end of the lever 87 is connected by a pivot 88 to a vertically disposed rod 89 having its lower end secured by a pivot 91 to a bracket 92 which is secured at the rear end of a pressure plate 93. The lever 87 has a fulcrum 94 between the pivots 86 and 88 which divides the lever into a rear lefthand end section which is twice as long as the forward or righthand end section. The fulcrum 94 is of arcuate shape to extend into an arcuate recess 95 within the bolt head 73. The pressure plate 93 is supported on the ends of four bolts 95 which secures a ram 96 to a plate 97 on the top of the forwardly extending bottom arms 98 of the C-shaped plates. The pressure plate 93 is moved upwardly by a piston rod 99 when the piston within the cylinder of the ram 96 is moved upwardly within the cylinder.

The upper movement of the pressure plate 93 carries the bracket 92 and vertical rod 89 upwardly therewith to rock the lever 87 and apply pressure on the clevis 85 to push downwardly on the pressure plate 84 which further compresses the spring 67. The pressure plates 84 and 93 are to have a movement of approximately 1 inch, the pressure plate 84 in a downwardly direction, the pressure plate 93 in an upward direction. This is all the movement that is required to set the nails of the nail plates 29 since they are approximately ½ inch in length. The actual upward movement of the pressure plate 93 is two inches but since the supporting C-frame moves downwardly an inch, the downward movement is that of the pressure plate 84 and the upward movement of the plate 93 has a resultant movement upwardly of 1 inch. Since both of the C-frames are of exact construction, only the one above described need be discussed in detail. One of the C-frames may be actuated alone or both may be operated simultaneously, as pointed out above.

In FIG. 1, the cross member 134 has nail plates 29 placed on the platforms 27 at the junction at the opposite sides of the table with the runners 31 and 32 and with the adjacent end of the angularly disposed cross member 134. The bottom pressure plates 93 of the two C-frames engage the platforms 27 as the pressure plates 84 moves downwardly to engage the nail plates 29 which were placed upon the top of the cross member 134 at the opposite ends to be joined to the other truss members. The nails on the nail plate 29 are lanced from the plate to be disposed as close as possible to each other so as to provide a large number of nails in the small area of the plate.

The platforms 27 are approximately one-half inch from the members of the truss so that when the nail plates 29 with the ½ inch projecting nails are placed thereon, they will be out of engagement with the truss members. The movement of the nail plates 29 toward each other under a pressure of approximately 16 tons will force the nails within the abutted ends of the truss members and will set them to depth to securely hold the abutted ends of the members in firm, fixed relation. After the nail plates 29 are set at the platform 27 indicated at 101, the carriage is moved to the right in FIG. 1 to have the righthand C-frame aligned with the pressure plate 102 so that the facing nails of the top and bottom nail plates 29 can be set when the pressure plates are operated toward each other.

The carriage is moved to the next pressure plate, 27 indicated at 103 where the nail plates 29 will be set by the operation of the pressure plate 84 and 93 on the lefthand C-frame. In this manner, the carriage will be moved from one platform to the next or to oppositely disposed platforms so that the left or the right-hand C-frame or both may be operated independently or simultaneously to set the nail plates 29.

It will be noted that the truss at the center has a rectangular opening 104 which is provided for a heating and/or cooling duct to be supported therein. Since the dimension of the ducts and the position of the rail 116 will change, it is necessary to have the central portions 105, 106 of the table adjustable so as to be able to have the platforms 117 moved lengthwise of the machine to a position where they may be raised by the pressure plate 93 when moved into alignment therewith.

Since the angular disposed cross members 33 of the truss are of predetermined equal length, any change made thereon near the center portions 105 and 106 of the table will make it necessary to have both end portions of the table adjusted therewith so that the ends of the elements 33 will fall substantially half ways between the transverse members 22 of the table to be substantially on the center of the platforms 27 which are raised to set the top and bottom nail plates 29 at the joints. To this end, the central cross member 108 is fixed against movement to form a fixed center while the cross members 109 at each end thereof are movable with each outward table portion. Between the cross members 108 and 109 downwardly presenting channel members 112 are mounted each side of center with one end attached at points 113 to members 109 in telescoped relation to the downwardly presenting channel members 111 which are fixed to the central cross member 109 both sides thereof and at both sides of center.

The outside telescoped members embody inwardly projecting channel elements 114 telescoped over an inwardly presenting channel element 115, the channel elements having their ends extending within reversed bent ends 116 in both of the inner and outer pairs of telescoped members. The outer members 112 and 114 are secured to both sides of the movable transverse members 109 while the pair of inner channel elements 111 and 115 are secured to both sides of the central transverse element 108. With this arrangement, when the tables at each end of the central portions 105 and 106 are adjusted longitudinally to permit the raisable platforms 117 to be shifted into the proper positions, the table at each end of the central portion will be located so as to have the platforms 27 disposed adjacent to the points where the ends of the cross members of the truss engage the edge runners 31 and 32 thereof. The platforms 117, as illustrated in FIG. 9, has the inner end 118 extending over each side of the longitudinal center and rest upon the downwardly presenting channel element 112. The opposite or outer edge has an angle member 24 secured along the edge with the top flange engaging the top of the reversely bent bottom flange of the outer channel element 114.

It can be seen that when the adjacent cross members 109 are shifted toward or from the central cross member 108 that the platforms 117 are free to be adjusted lengthwise of the machine in order to be located where the nail plates are to be inserted into the points of engagement of the cross members and runners 31 and 32. The adjustment occurs when the inverted channel element 21 which is supported upon the square element 15 at the center of the machine is released when bolts 14 with a handle 13 are turned to loosen the nuts and the plates 17 so that the transverse members 22 and central member 21 forming the table top may be slid toward or from the central cross member 108. After the adjustment which, at most, only amounts to half the distance between the cross members 22, the bolts 14 are again tightened and the platforms 117 shifted longitudinally to be located at points where the nail plates are to be inserted.

It has been pointed out hereinabove that the truss may be of different heights, usually from 12 inches to 24 inches and that stop elements 121 are clamped to the upwardly presenting channel of the cross members 22 to locate and back up the runners 31 and 32 of the truss. The element 121 is illustrated in FIG. 3 as embodying a length of tube 122 having a plate 123 welded to the bottom through which a bolt 125 extends with its heat abutting the plate. A guide strip 16 is welded to the plate 123 located between the reversely bent ends 26 of the cross member 22. The bolt is threaded into a nut 126, which is welded or otherwise secured to a plate 127 having edges 128 at the side which extend within the recesses 129 formed by the inwardly rolling edges 26 when the bolt is tightened upon inserting a socket wrench within the tube 122. Upon tightly clamping the plate 129 to the cross members 22, the tubes 121 are retained in fixed accurately located positions. This same type of clamp is employed on the channel shaped element 131 which is used to locate the cross members 134 at the ends of the central opening 133 for the conduit.

Since the cross members 134 may be located at different points, it is necessary to move the entire table at each end of the central portion outwardly and inwardly to provide length to the opening while maintaining the abutted ends of the cross members 33 at points centrally of the platforms 27 so that the nail plates 29 may be inserted at the joints as the carriage 37 is advanced to the points where the joints are located. It will be noted in FIG. 1 that the end cross member 134 of the frame is abutted by elements 135 which are secured to the transverse member 22 in a manner pointed out with regards to the tubular element 121 of FIG. 3. A longer element 136 is secured to three of the transverse members 22 to back up the end of the top runner 31 which could strike the end with a substantial force which the cross member 136 is capable of withstanding.

The carriage 37, which has both of the C-frames 65 which face each other disposed in aligned relation is advanced to the left in position to have both C-frames simultaneously operated it the platform 101 to set the nails of the top and bottom nail plates 29 which are disposed at the ends of the cross member 134. The next adjacent platform 102 is on the righthand side of the machine and only the righthand C-frame 66 will be employed to set the nails of the nail plates 29 which are provided at the top and bottom of the truss members. The platform 103 on the lefthand side of the table will be engaged by the lefthand side of the table will be engaged by the lefthand C-frame to set the nails of the nail plates 29 thereat. In this manner, one or the other or both of the C-frames will be employed when setting the nails of the nail plates. this being particularly true for the platforms 117 at the central part of the machine. By advancing the carriage 37 from the forward to the rearward end of the machine and by operating one or both of the C-frames at one or aligned platforms, the joined ends of the truss members will be secured together under maximum pressure conditions.

In the present machine, the carriage supporting rails 38 are 62 inches apart. Seven legs 11 support the table, one being mounted at the center with three disposed each side thereof substantially 65 $\frac{5}{8}$ inches apart. A wire is stretched at a predetermined height so that the table and rails can be shimmed at an exact height in perfect parallelism. The top of the cross members 22 are preferably 29 $\frac{3}{4}$ inches high and the platforms 27 and 117 are 29 $\frac{1}{4}$ inches in height leaving $\frac{1}{2}$ inch for the nails of the nail plates 29.

The floor engaging elements 12 are lag-bolted thereto through slots which permits some adjustment. The channel cross members 22 are welded to the central channel member 21 and are approximately 15 inches apart to permit the movement of the 15-inch platforms vertically therebetween. The tank, pump and motor unit 51 is of standard construction and is used for delivering fluid to and from the rams 96 provided on each of the C-frames 65. Each of the pressure plates 84 and 93 move toward each other one inch for setting the nails of the nail plates 29 for securing the ends of the truss members in firm fixed relation to each other.

As pointed out hereinabove, the locating elements such as the member 131 will be bolted to elements of the table to locate the opening 133 in the truss. It was pointed out that the opening could have its center to the right or left of the central element 108. At the lefthand end of the machine, which is also true of the righthand end, the back-up channel elements 135 have plates 138 thereon. When secured to an adjacent cross member 22 by bolts 125, the plates 138 hold the cross member 134 in exact position. Such bolted elements can be employed at any place along the table depending upon where bracing is required.

It is noted that the nail plates 29 are in dot and dash line in FIGS. 1 and 2 with the nails thereof extending upwardly, a similar plate is employed thereabove with the nails directed downwardly so as to have both of the nail plates set when the C-frames 66 have their pressure plates 83 and 93 operated toward each other. When this occurs, both of the nail plates will be forced toward each other into the ends of the abutted members of the truss. It is to be understood that the pump unit driven by the motor 51 produces the pressure fluid which is passed through a pair of conductors 141 to the lefthand ram 96 while the pair of conductors 142 pass through the inverted channel members 56 and are connnected to the ram 96 on the righthand C-frame 66. The conductors pass through solenoid operated valves on the pump unit which directs the fluid to and from opposite sides of the piston within the rams to have the piston rod 99 advanced or retracted.

What is claimed is:

1. In a machine for fastening members of a truss in firm fixed relation with each other, a table having a central and opposite end portions on which the members of the truss are assembled with their ends in abutted relation, a carriage movable along the entire length of said table, means on said central table portion which is adjustable toward and away from the transverse center of the table along with the opposite end portions which move as units, and means on said carriage at opposite longitudinal edges of said table which are vertically movable toward and away from each other for forcing the nails of nail plates into the bottom and top of the abutted portions of the assembled truss members at one or both edges simultaneously.

2. In a machine for fastening members of a truss together as recited in claim 1, wherein said central table portion has telescoped elements fixed to said table portions at the opposite ends thereof which extend or contract said central table portion when said table portions at the opposite ends are adjusted toward or from the center of the central table portion.

3. In a machine for fastening members of a truss together as recited in claim 2, wherein platforms on said central table portion are adjustable lengthwise thereof relative to said truss abutted members located in a position to be raised to set the nails of a nail plate which rests thereon.

4. In a machine for fastening members of a truss together as recited in claim 1, wherein said entire end table portions at the opposite longitudinal ends of the central table portion has locking means for releasably securing said end table portions in unit adjusted position.

5. In a machine for fastening members of a truss together as recited in claim 3, wherein said table has transversely disposed members spaced equal distance apart, platforms supported between said transversely disposed members each side of the longitudinal centerline of the machine which are adjustable toward and away from said centerline and raisable to set the nails of nail plates supported thereon.

6. In a machine for fastening members of a truss together as recited in claim 5, wherein said carriage has a C-frame thereon, pressure plates on said C-frame movable toward each other to set nails of nail plates on the top and bottom of abutted ends of the truss members.

7. In a machine for fastening members of a truss together as recited in claim 6, wherein a pair of facing C-frames are mounted on said carriage for adjustment toward and from each other corresponding to the lateral adjustment of said platforms for trusses of different heights.

8. In a machine for fastening members of a truss in firm fixed relation with each other, a pair of spaced rails, a carriage driven forwardly and rearwardly on said rails, a pair of facing C-frames adjustably mounted on said carriage for movement toward and away from each other, a table supported on legs on which the members of the truss are assembled in predetermined relation, a pair of cylinders each having a piston rod and piston therein secured to the lower part of each said C-frame, a bottom pressure plate on said C-frames movable upwardly by said piston rods, a top pressure plate secured to the upper part of said C-frames aligned with said bottom pressure plates, lever means operated by said bottom pressure plates when moved upwardly for moving the C-frames and top pressure plates downwardly, and a supply of pressure fluid delivered to said cylinder for moving said top and bottom pressure plates toward each other for securing nail plates in the areas where the ends of the members of the truss abut each other.

9. In a machine for fastening members of a truss together as recited in claim 8, wherein said carriage has a transverse I-beam near the top provided with top and bottom flanges, a hanger for each said C-frame having wheels thereon which roll on the bottom flanges of said I-beam to permit the C-frames to be adjusted toward and away from each other.

10. In a machine for fastening members of a truss together as recited in claim 9, wherein means are provided on said bottom flanges of the I-beam for locking the hangers in adjustable position thereon.

11. In a machine for fastening members of a truss together as recited in claim 9, wherein spring means on the hangers support the C-frames, a vertical movable rod, a lever on each C-frame having one end fastened to the upper fixed pressure plate and the opposite end secured to said vertical movable rod, and a bracket on the lower pressure plate connected to the bottom of said rod so that the upward movement of the bottom pressure plate will move the top pressure plate downwardly relative thereto.

12. In a machine for fastening members of a truss together as recited in claim 11, wherein said lever is fulcrumed at one end of the spring with the length thereof adjacent to the operating rod being twice the length of the opposite end thereof so that the downward movement of the top pressure plate will be one-half of the upward movement of the bottom pressure plate.

13. In a machine for fastening members of a truss together as recited in claim 8, wherein the plurality of legs supporting the table embody transversely disposed upwardly presented channel elements which extend through the central portion of the C-frames, flanges extending outwardly from the sides of the channel elements in aligned relation, and freely movable plates supported on said flanges for adjustment toward and away from the center of the machine and upwardly toward the truss members to carry the nail plates upwardly when the bottom pressure member is moved upwardly.

14. In a machine for fastening members of a truss together as recited in claim 13, wherein the C-frames are supported on the spring means to permit the upward movement of the bottom pressure plate for causing the associated C-frame to move downwardly to advance the top and bottom pressure plates against nail plates engaging the truss members to simultaneously have the nails inserted from the top and bottom by the pressure expended by the two pressure plates when moved toward each other.

15. In a machine for fastening members of a truss together as recited in claim 8, wherein the central part of the machine has a central transversely disposed cross member from and toward which the end portions of the machine are adjustable, and platforms in said central part which are adjustable lengthwise of the machine.

* * * * *